US006608544B2

(12) United States Patent
Yoshioka et al.

(10) Patent No.: US 6,608,544 B2
(45) Date of Patent: Aug. 19, 2003

(54) REACTOR

(75) Inventors: Yoshinori Yoshioka, Nakakoma-gun (JP); Keiichi Hosokawa, Nakakoma-gun (JP); Kazuya Onodera, Nakakoma-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 09/912,496

(22) Filed: Jul. 26, 2001

(65) Prior Publication Data

US 2002/0014941 A1 Feb. 7, 2002

(30) Foreign Application Priority Data

Jul. 28, 2000 (JP) ..... 2000-228936

(51) Int. Cl.[7] ..... H01F 27/28

(52) U.S. Cl. ..... 336/184; 336/65; 336/178; 336/212

(58) Field of Search ..... 336/178, 212, 336/65, 180–185, 210, 214–216, 220, 221

(56) References Cited

U.S. PATENT DOCUMENTS 4,055,826 A * 10/1977 Franz ..... 336/178
5,335,163 A * 8/1994 Seiersen ..... 336/178
5,563,778 A * 10/1996 Oh ..... 336/212
5,587,694 A * 12/1996 Minato et al. ..... 336/65

FOREIGN PATENT DOCUMENTS

JP B1 2905186 3/1999

* cited by examiner

*Primary Examiner*—Tuyen T. Nguyen
(74) *Attorney, Agent, or Firm*—Oliff & Berridge, PLC

(57) ABSTRACT

A reactor in which two first cores 1 made of lamination and I-shaped and two second cores 2 made of lamination and I-shaped are disposed such that the two first cores are parallel to each other, the two second cores are parallel to each other and that the two second cores having respective coils 4 therearound are perpendicular to the two first cores, thereby forming a rectagular shape, wherein there are provided a first spacer 10 and a second spacer 20, which have on their respective outward side faces two protrusions 13, 23 for positioning each first core and two other protrusions 14, 15 for holding longer sides of each first core with one thereof having at its tip end an engaging mechanism to secure each first core, and which have on their respective inward side faces four protrusions 17, 27 for positioning two neighboring corners of the respective second cores and an elevated portions 16, 26 provided between the four protrusions and elevated in a direction perpendicular to the length of the first cores. As a result, the reactor has a good workability and a reduced number of parts.

8 Claims, 10 Drawing Sheets

REACTOR

BACKGROUND OF THE INVENTION

1. Field of the Invention

The present invention relates to a reactor used in an inverter circuit, a smoothing circuit, an active filter or the like.

2. Description of Related Art

Conventionally, a reactor as shown in FIG. 11A has been used in an inverter circuit, a smoothing circuit and an active filter or the like. As shown in FIG. 11A, a magnetic core portion of the reactor comprises four cores made of lamination and I-shaped which are arranged such that two first cores 1 made of lamination and I-shaped are disposed so as to be parallel to each other, and two second cores 2 made of lamination and I-shaped are disposed so as to be parallel to each other, in which the first cores 1 are disposed perpendicular to the second cores 2 thereby forming a rectangular shape, and as shown in FIG. 11B, gap members 5 are inserted between the first cores 1 and the second cores 2 to construct a magnetic circuit. The reason for combining the four cores made of lamination and I-shaped forming a rectangular shape, instead of combining one core made of lamination and E-shaped and another core made of lamination and I-shaped, is to use a core high in magnetic flux density and magnetic permeability in order to enable downsizing in size and profile.

As a core being low in noise, high in magnetic flux density and magnetic permeability, a silicon steel plate containing 6.5% of silicon, for example, NK SUPER E (registered trademark) provided by NKK Corporation, or the like, has been often used. Such a silicon steel plate as containing some 6% of silicon is almost zero in magneto striction and therefore has advantages of low noise, large saturation magnetic flux density such as 1.8T, and low iron loss at high frequency. However, since a large amount of silicon is contained, it is hard and fragile. Accordingly, silicon steel plates punched out into an E-shape are apt to be chipped or broken. Therefore, four cores each formed of plates cut into an I-shape and laminated are combined as mentioned above thereby constituting a magnetic core of the reactor.

FIGS. 11A and 11B show the cores 1 and 2 made of lamination and I-shaped (hereinafter called "cores"), bobbins 3, and coils 4 (see, FIG. 11A) wound on the bobbins. The gap members 5 are inserted so as to form a suitable gap between the cores 1 and 2. Protrusions 6 are provided extending from ends of the bobbins to position the cores 1 and 2 relative to each other. The reactor is assembled such that the two bobbins 3, 3 shown in FIG. 11B are provided with respective windings, the two cores 2 are inserted into the two bobbins 3, 3, respectively, the gap members 5 and both ends of the two cores 1 are engaged with the protrusions 6 extending from the both ends of the bobbins, positioned, temporarily held and fixed thereto by means of a metal fitting, an adhesive or the like. The ends of the wound coils are soldered to terminals of a terminal block mounted on a metal frame to fix the reactor in, which is not shown.

The above mentioned bobbins are composed of insulating paper such as Nomex or the like. Therefore, it is difficult to position the four cores, which results in causing the cores 1 and 2 to shift from each other, thereby increasing variance of inductance. Moreover, there was also a problem of poor workability because an overflowing portion of an adhesive often used to fix the cores and the gap members to each other in order to reduce noise must be removed.

Further, since there are many constituent parts of the reactor such as parts composing a magnetic circuit of the reactor, parts for connecting the end of the coil to a terminal or the like, the large number of processes to manage the parts has been an obstacle to cost reduction.

Although a reactor using spacers to work as a mechanism to position gap members and cores and also as a receptacle to store an excessive adhesive was disclosed in Japanese Patent No. 2905186 to solve the foregoing problems, further improvements in workability and reduction in the number of parts have been demanded.

SUMMARY OF THE INVENTION

It is an object of the present invention to provide a reactor which has a structure enabling cores to be easily positioned relative to each other and easily adhered and fixed in place, ensures good workability, and reduces the number of parts, thereby solving the foregoing problems.

In order to achieve the foregoing object, a first aspect of the present invention relates to a reactor in which two first cores made of lamination and I-shaped and two second cores made of lamination and I-shaped are disposed such that the two first cores are parallel to each other, the two second cores are parallel to each other and that the two second cores having respective coils therearound are perpendicular to the two first cores, thereby forming a rectangular shape, wherein there are provided a first spacer and a second spacer integrated with a terminal block, which are molded of insulating resin, disposed parallel to each other with the two first cores set apart from each other so as to sandwich the two second cores, have on their respective outward side faces two protrusions for positioning each first core and two other protrusions for holding longer sides of each first core with one thereof having at its tip end an engaging mechanism to secure each first core, and which have on their respective inward side faces four protrusions for positioning two neighboring corners of the respective second cores and an elevated portion provided between the four protrusions and elevated in a direction perpendicular to the length of the first cores.

According to a second aspect of the invention, in the first aspect, the first spacer and the second spacer are each formed such that a thickness at portions where the first spacer and the second spacer contact with the first cores and the second cores is equal to a predetermined gap length between the first cores and the second cores.

According to a third aspect of the invention, in the first or second aspect, the terminal block integrally formed on the second spacer is provided with a plurality of terminal insertion holes going therethrough in an insertion direction, and the terminal insertion holes each have a plurality of apertures connecting therewith.

According to a fourth aspect of the invention, in the first to third aspect, a gutter for adhesive to flow into is provided on the first spacer and the second spacer at areas with which the first cores and the second cores are in contact.

According to a fifth aspect of the invention, in the first to fourth aspect, the elevated portion provided on the respective inward side faces of the first spacer and the second spacer is formed so as to contact with two other neighboring corners of the respective second cores, which are not in contact with any of the four protrusions.

According to a sixth aspect of the invention, in the first to fourth aspect, the elevated portion provided on the respective inward side faces of the first spacer and the second spacer is formed so as to contact with one longitudinal surface of the respective second cores, which is not in contact with any of the four protrusions.

According to a seventh aspect of the invention, in the first to sixth aspect, the four protrusions provided on the respective inward side faces of the first spacer and the second spacer are formed such that inner faces thereof hold the second cores and outer faces thereof engage with inner peripheries of the coils wound around the second cores.

According to an eighth aspect of the invention, in the first to seventh aspect, one of the two other protrusions provided on the respective outward side faces of the first spacer and the second spacer has two slits thereby being split into three sections and a middle section of the three sections is provided with elesticity and has the engaging mechanism at its tip end.

As mentioned above, the reactor according to the invention is provided with the the two protrusions for setting the first cores at predetermined positions and the two other protrusions for holding the longer sides of each first core at the respective outward side faces of the first spacer and the second spacer integrally molded with the terminal block, both the first and second spacers being disposed parallel to each other with the first cores set apart from each other so as to sandwich the second cores. One of the two other protrusions for holding the longer sides has at its tip end the engaging mechanism to secure each first core that is positioned with the two protrusions. The four protrusions are provided on the respective inward side faces of the first spacer and the second spacer which face each other so as to position the two neighboring corners of the respective second cores and secure the position of the second cores.

Moreover, the elevated portion provided together with the four protrusions for positioning the two corners, that is three sides of each second core, works to position one remaining side thereof, and also to reinforce the spacers when the gap length between the first core and the second core is small.

Further, the apertures provided around the respective terminal insertion holes connecting therewith work to let varnish smoothly flow out.

DETAILED DESCRIPTION OF THE PREFERRED EMBODIMENTS

Figure 1:
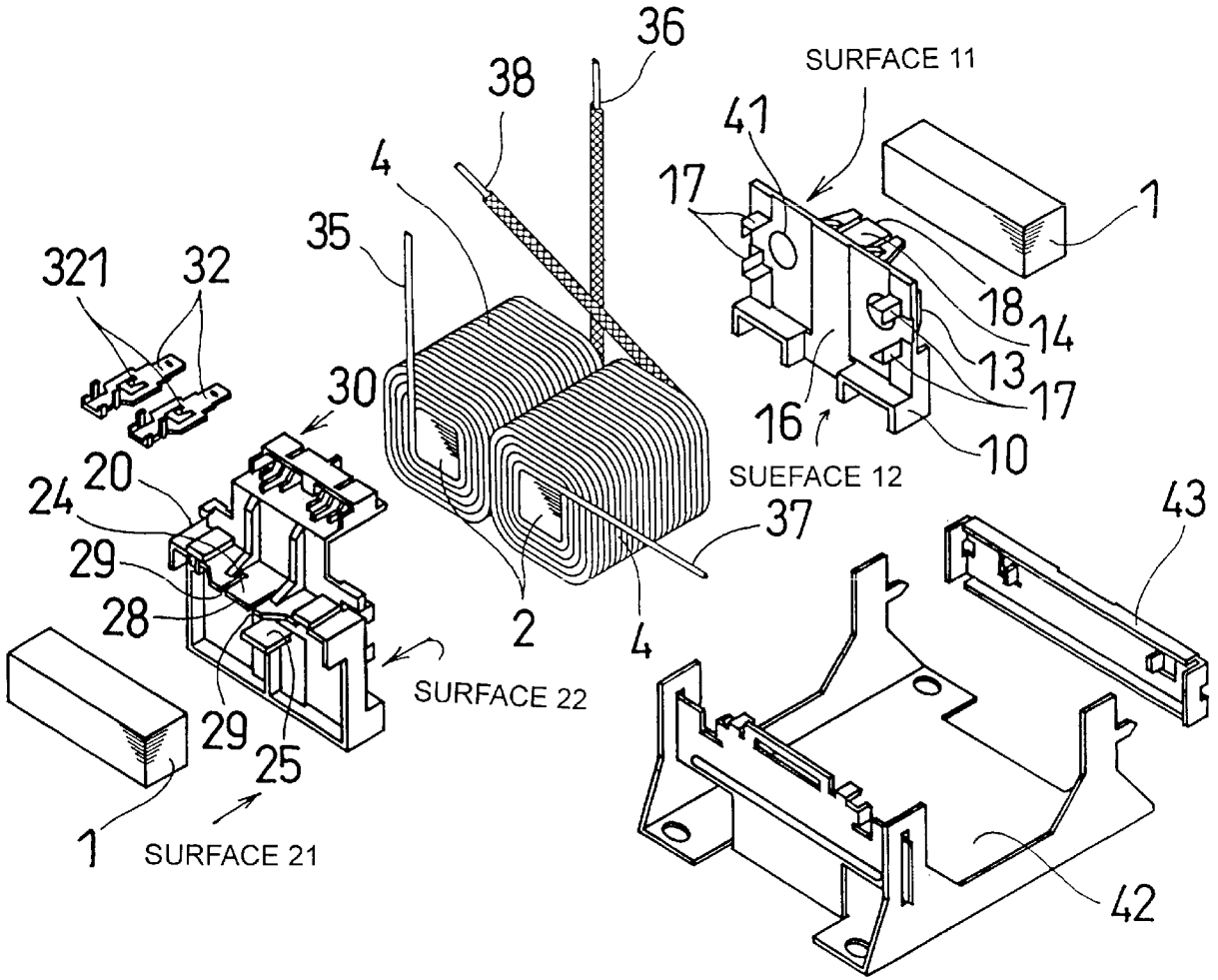
FIG. 1 is an exploded perspective view showing main constituent members of a reactor according to the invention.

A reactor of the present invention will hereinafter be described with reference to the drawings. FIG. 1 shows main members constituting the reactor of the invention. As shown in FIG. 1, the reactor of the invention generally comprises two first cores 1 made of lamination and I-shaped, two second cores 2 made of lamination and I-shaped to be inserted into two coils 4 and 4, respectively, a first spacer 10, and a second spacer 20 integrally molded with a terminal block 30. The reactor assembled with these members is set in a metal frame 42 and fixed by a side plate 43.

The first spacer 10 and the second spacer 20 are molded of insulating resin such as PET (polyethylene terephthalate) or the like. One of the first cores 1 is set onto a face 11, that is one face of the first spacer 10, and another first core 1 is set onto a face 21, that is one face of the second spacer 20 with the terminal block, both in such a way as to be positioned and secured by protrusions featured in the invention, and, if necessary, fixed by adhesive.

The two second cores 2 have an insulating tape of Nomex paper with a thickness of about 0.13 mm wrapped therearound in order to improve insulation from the wound coils 4, into which the two second cores are inserted, respectively. The second cores 2 are set onto a face 12, that is another face of the first spacer 10, and a face 22, that is another face of the second spacer 20, respectively, in such a way as to be positioned and secured by four protrusions, and, if necessary, fixed with adhesive.

Only some of the protrusions for positioning can be seen from the angle shown in FIG. 1, and are denoted by, for example, reference numeral 17 in the first spacer 10, reference numeral 25 in the second spacer 20, and so on. The mechanism of positioning will be described later.

As shown in FIG. 1, a gutter (for example reference numeral 41) for adhesive to flow into may be provided on the first spacer 10 and the second spacer 20 if necessary, as mentioned later.

In general, a gap is provided between the first cores and the second cores in order to adjust an inductance value of the reactor. In FIG. 1, a gap length required between the first cores and the second cores is ensured by the first spacer 10 and the second spacer 20. In other words, the respective spacers have a thickness set equal to a predetermined gap length to achieve a prescribed value of inductance.

After positioning and fixing the four cores, lead wires 35, 36, 37 and 38 of the coils 4, 4 are connected to terminals 32 to be inserted into terminal insertion holes (not shown) of the terminal block 30 integrally put on the second spacer 20 so as to provide the reactor with an electrical function.

Figure 2:
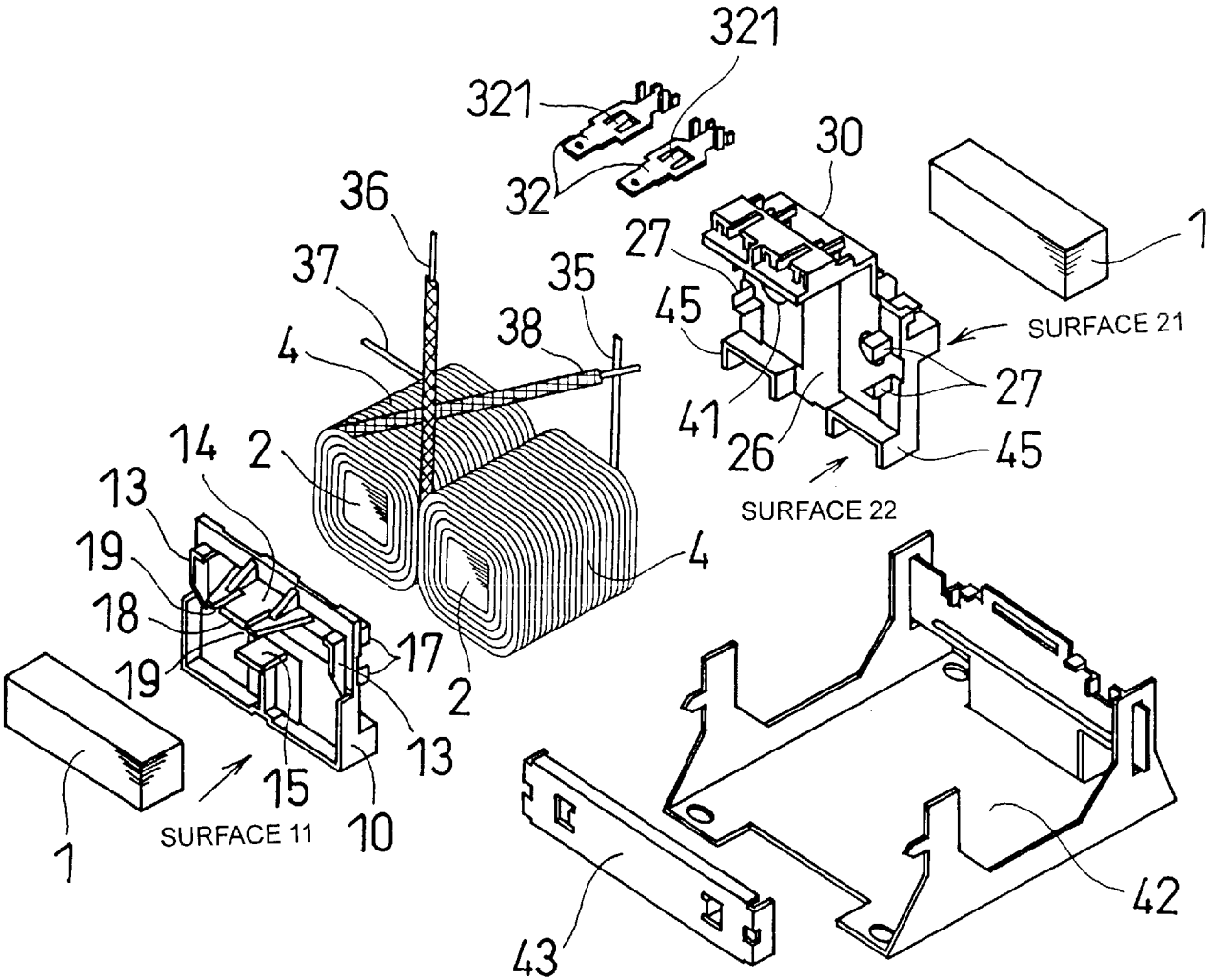
FIG. 2 is an exploded perspective view showing the main constituent members of FIG. 1 from an opposite direction.

FIG. 2 shows the main members constituting the reactor from an opposite direction from FIG. 1 so as to expose structures of the face 11 of the first spacer 10 and the face 22 of the second spacer 20.

Although there is difference in the dimension of a protrusion 14 which is one of the protrusions for positioning and securing the first core at the longer sides and in the reference numerals in the drawing, the face 11 of the first spacer 10 has the same structure as the face 21 of the second spacer 20 shown in FIG. 1 with respect to the mechanism to hold the first cores except that the second spacer 20 has the terminal block 30. A protrusion 23 positions one of the first cores in the longitudinal direction, and corresponds to a protrusion 13 in FIG. 3.

Similarly, although there is difference in the reference numerals in the drawing, the face 22 of the second spacer 20 has the same structure as the face 12 of the first spacer 10 shown in FIG. 1 with respect to the mechanism to hold the second cores except that the second spacer 20 has the terminal block 30.

As mentioned above, the reactor, which is assembled with the two first cores 1, 1, the two second cores 2, 2 to be inserted into the two coils 4, 4, the first spacer 10 and the second spacer 20 integrally molded with the terminal block 30, is set in the metal frame 42 and fixed by the side plate 43.

As clear from the foregoing description, the first spacer 10 and the second spacer 20 serve as a gap member and position and fix the cores. Further, the second spacer 20 also functions as a terminal block for connecting the coils with an external circuit.

Figure 3:
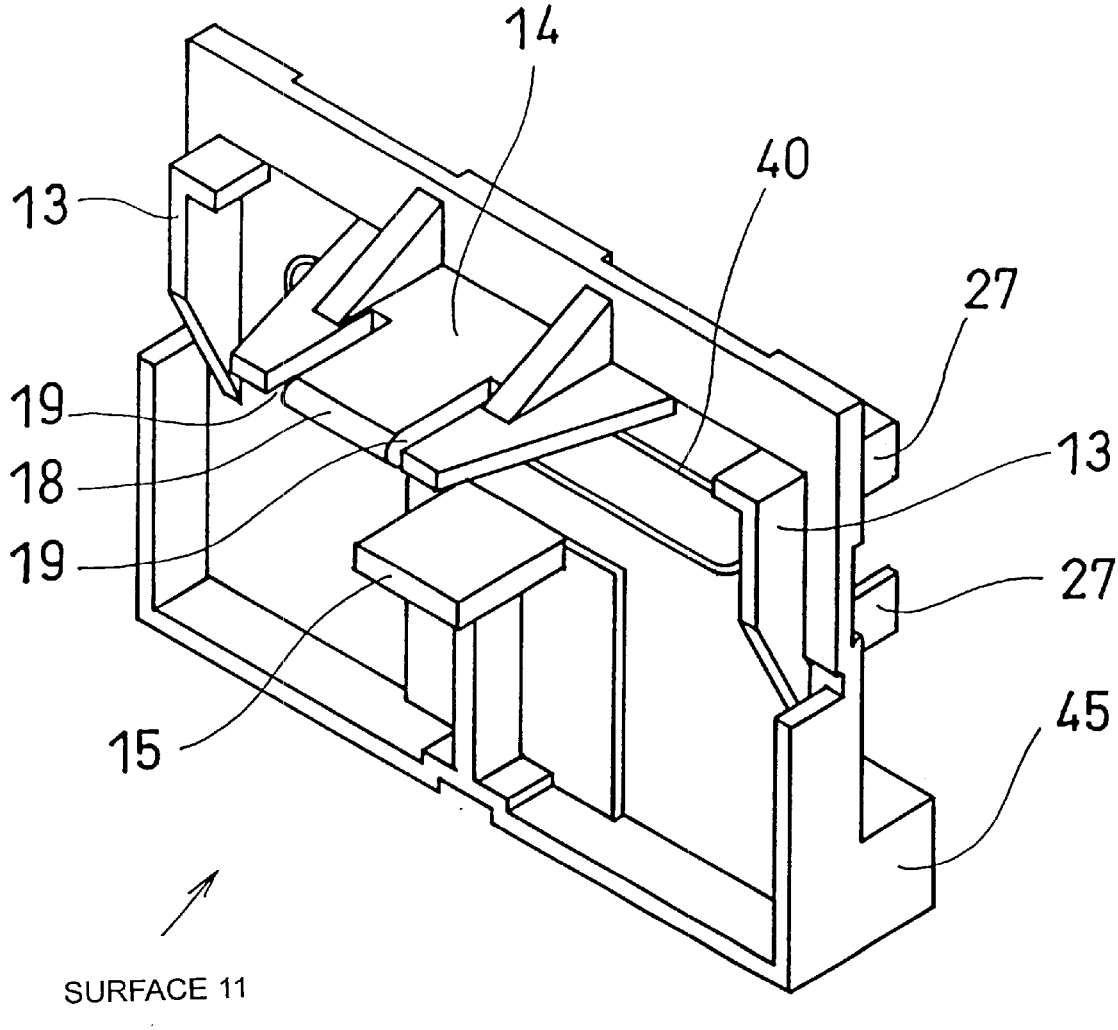
FIG. 3 is a perspective view showing an embodiment of an outward side face of a first spacer for receiving a first core.

FIG. 3 is a perspective view showing an embodiment of the face 11 of the first spacer 10 for receiving one of the first cores. Hereinafter, a structure of the spacer, that is one of the characteristics of the invention, will be described.

Figure 4:
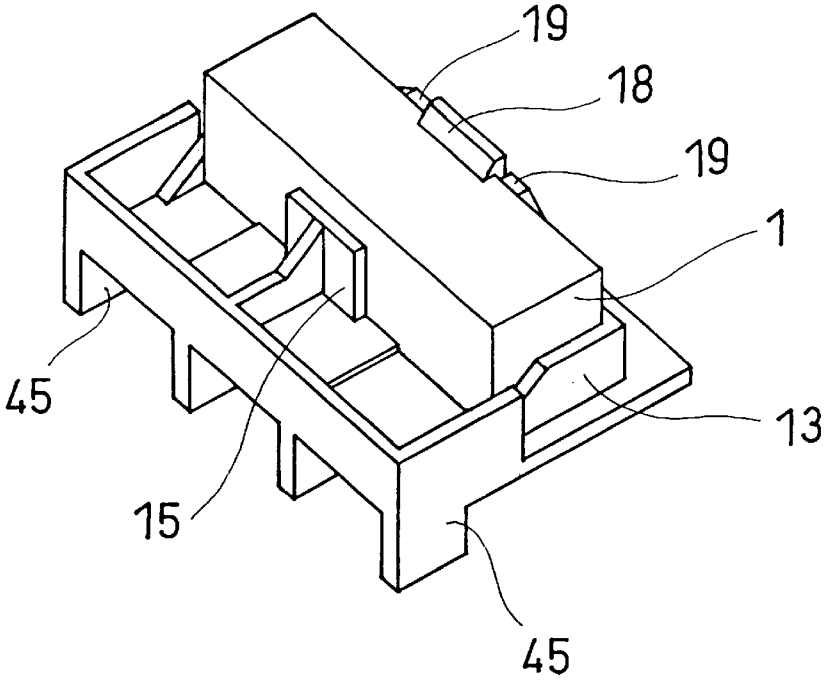
FIG. 4 is a perspective view showing how the first core is disposed in the first spacer.

One of the first cores 1 is placed along the length of the first spacer 10 as shown in FIG. 4 in such a manner as to be surrounded by protrusions 13, 14 and 15 for positioning in FIG. 3. The two protrusions 13 position two corners of the first core 1. The protrusions 14 and 15 position two longer sides of the first cores 1. As mentioned above, the protrusion 14 positions one of the longer sides of the first core 1 and also secures the first core 1. That is, the protrusion 14 is sectioned into three by slits 19 so as to have elasticity at its middle section and an tip end 18 of the middle section is provided with a mechanism to lock the core placed and positioned.

The first core 1 to be placed is coated with adhesive, positioned and secured by the protrusions 13, 14 and 15, and fixed by means of adhesive. As shown in FIG. 4, the first core 1 is positioned by the protrusions 13, 14 and 15, secured by the mechanism provided at the tip end 18 of the middle section of the protrusion 14 having elasticity, and fixed by being pinched at the face 11. Accordingly, the first core 1 does not shift after it is positioned and secured even if the spacer 10 is moved to another place for the convenience of assembly process before the adhesive sets, and therefore variance in inductance due to the shift of the first core 1 in assembly process can be reduced significantly.

Figure 6:
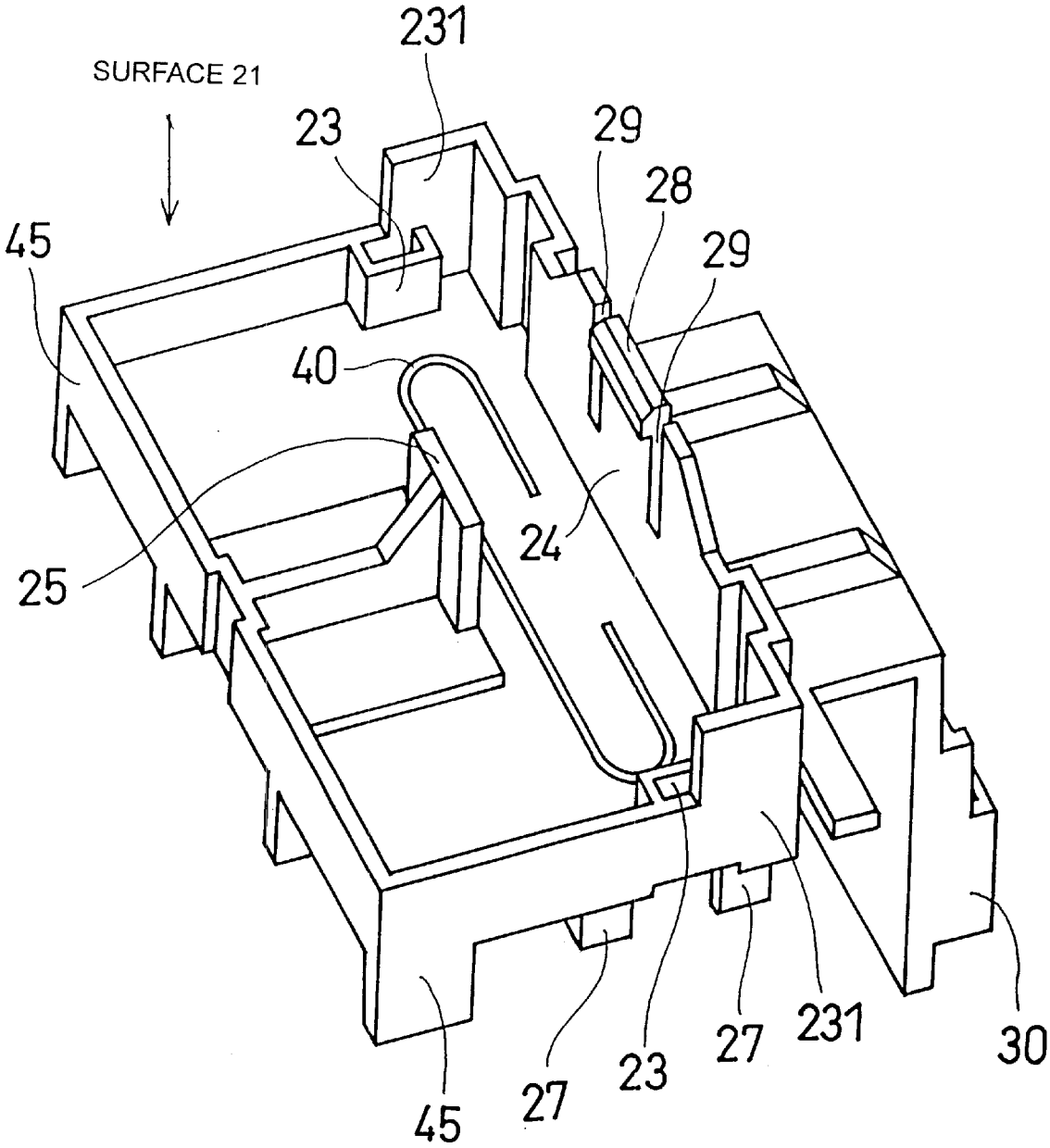
FIG. 6 is a perspective view showing an embodiment of an outward side face of a second spacer.

FIG. 3 shows partly a gutter 40 for receiving excessive adhesive. (FIG. 6 shows entirely the gutter 40.) Adhesive is applied between each spacer and each first core in order to reduce noise, but the adhesive is forced outside due to the flat surfaces of both the spacer and the core, which can cause the adhesive not to be applied entirely, thereby giving unevenness in the strength of adhesion. In order to prevent such a problem, for example, a shallow groove running in an ellipse as shown is provided at a surface of the spacer 10, with which the first core 1 is to contact, so that the adhesive, which otherwise overflows at the time of pressing the first core 1 to the spacer 10 for adhesion, gets in the gutter 40 consisting of the groove in ellipse and remains there.

Figure 5:
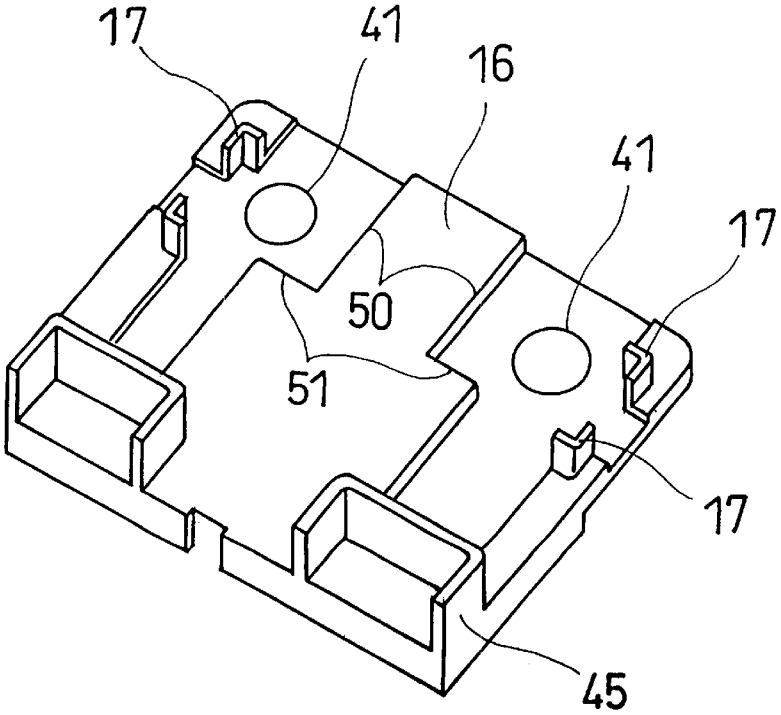
FIG. 5 is a perspective view showing an embodiment of an inward side face of the first spacer.

FIG. 5 is a perspective view showing the face 12 of the first spacer 10. Reference numeral 17 denotes protrusions for positioning the second cores 2. An elevated portion 16 elevated in a direction perpendicular to the length of the first core consists of two portions. One portion includes sides 50, each of which contacts with a longitudinal surface of the respective second cores 2, with which the protrusions 17 do not come into contact, thereby positioning the second cores 2. Another portion includes sides 51 which are continuous with the respective sides 50 and reinforces the first spacer 10 when the gap length between the first core and the second core is small, which forces the spacer to have a small thickness.

For the same reason described about the gutter 40 provided on the face 11 of the first spacer 10, for example, a gutter 41 for receiving adhesive is provided on the face 12 of the first spacer 10 in such a manner as to run in a circle without going beyond the area of the end surface of the second core 2.

The protrusions 17 are dimensioned and configured so as to hold the second cores at their inner surfaces and to engage with the inner peripheries of the coils wound around the second cores 2 at their outer surfaces for accurately positioning the coils relative to the second cores and for firmly holding the coils.

Moreover, protruding parts 45 are provided on the spacer in order to ensure a clearance from the metal frame 42 in case the coils 4 should shift downward by any chance.

FIG. 6 shows an embodiment of a structure on the face 21 of the second spacer 20. The second spacer 20 is integrally molded with the terminal block 30. Reference numerals 23, 24 and 25 denote protrusions for positioning one of the first cores. Similar to the protrusion 14 in the first spacer 10, the protrusion 24 is split into three sections by slits 29 and has a function to position and also secure the first core by an engaging mechanism 28 provided at the tip end of a middle section of the protrusion 24 having elasticity as mentioned above. Portions denoted by reference numeral 231 are to ensure a creepage distance between the first core and the lead wires 35 and 37 of the coils to be connected with the terminal 32.

In the second spacer 20, the first core 1 is positioned and secured by protrusions 23, 24 and 25 in the same way as in the first spacer 10.

Moreover, similar to the first spacer 10, protruding parts 45 are provided on the spacer in order to ensure a clearance from the metal frame 42 in which the reactor is set in case the coils 4 should shift downward by any chance.

Figure 7:
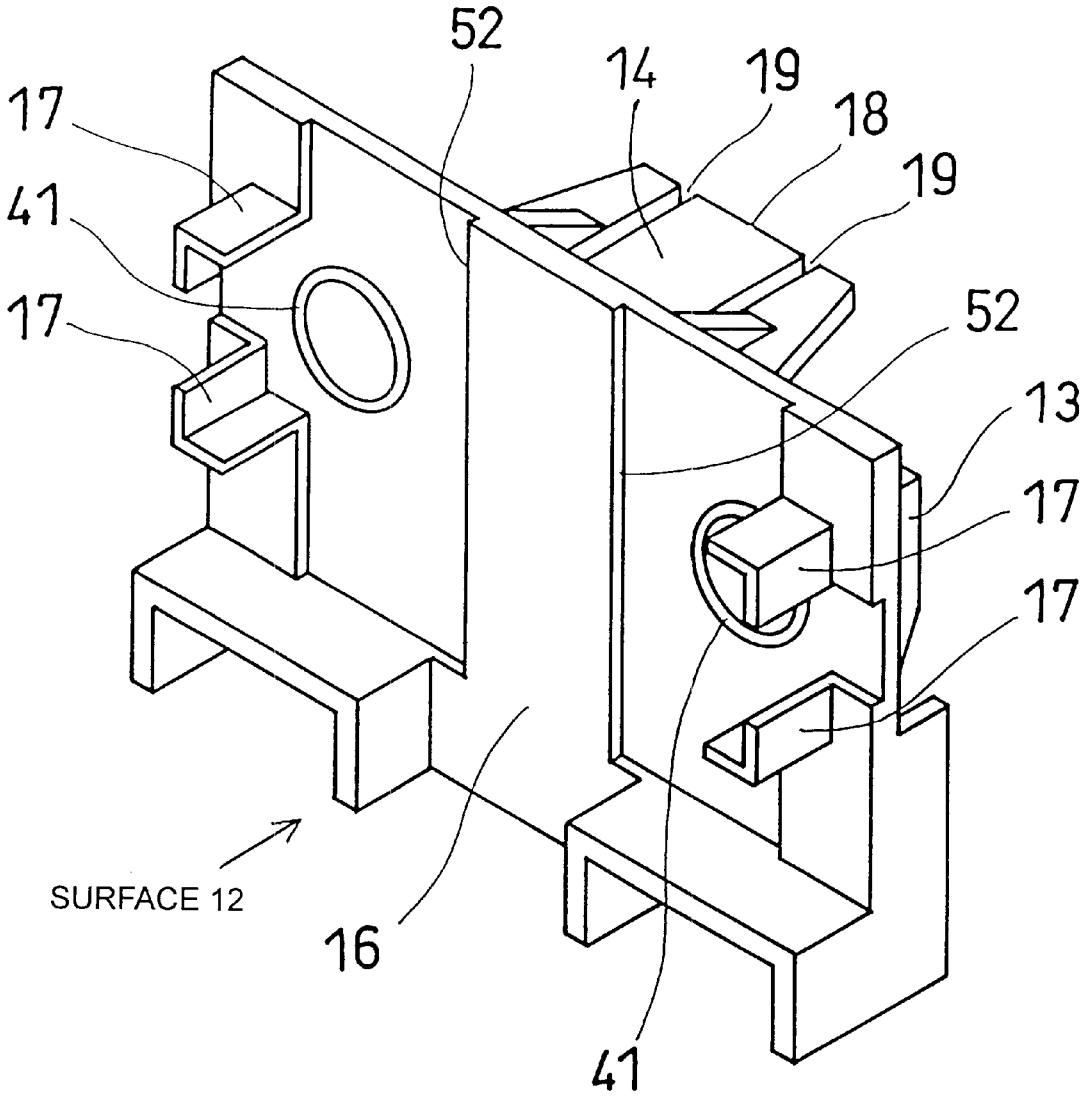
FIG. 7 is a perspective view showing another embodiment of the inward side face of the first spacer.

FIG. 7 shows another embodiment of the face 12 of the first spacer 10 with regard to the shape of an elevated portion for positioning an end of the second cores 2. This structure excludes the slides 51 shown in FIG. 5 where four protrusions 17 and sides 52, each of which contacts with a longitudinal surface of the respective second cores 2 with which the four protrusions 17 do not come in contact, jointly works to position the two second cores 2.

Figure 8:
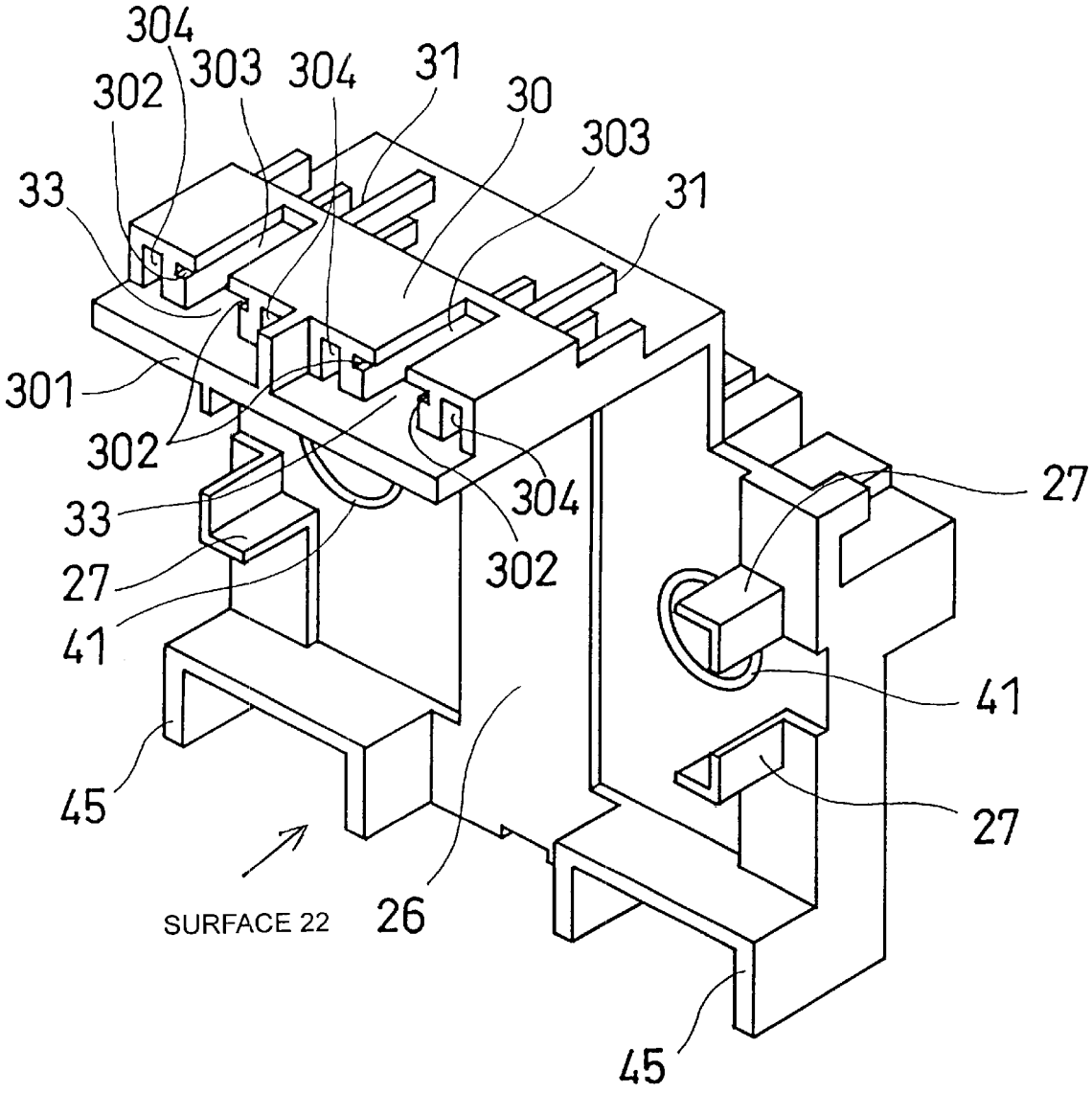
FIG. 8 is a perspective view showing an embodiment of an inward side face of the second spacer.

FIG. 8 shows a face 22 opposite to the face 21 of the second spacer 20. The face 22 positions accurately the end surfaces of the second cores and holds the second cores until they are fixed with adhesive. Similar to the face 12 of the first spacer 10, protrusions 27 for positioning the second cores, an elevated portion 26, and gutters 41 for receiving adhesive are provided on the face 22, where the second cores are positioned, held and fixed in the same way as on the face 12 of the first spacer 10 mentioned above.

Terminal insertion holes 33 in the terminal block 30 are for inserting the terminals 32 and go through the terminal block 30 in an insertion direction. In each of openings provided above a base plate 301 of the terminal block 30, grooves 302 having a width equivalent to the thickness of the terminal are provided in such a manner as to be clear of the base plate 301, and the terminals 32 are inserted into the respective grooves 302 from the face 21. When the terminal 32 is inserted all the way, a raised portion 321 of the terminal 32 shown in FIGS. 1 and 2 is caught at a cutoff 303, whereby the terminal 32 does not pull out.

A partition 31 is provided halfway through the terminal insertion hole 33 so that the terminal 32 can be easily inserted into the terminal insertion hole 33 and also that varnish can flow easily after impregnating process. Further, holes 304 internally connected with the respective grooves 302 and the terminal insertion hole 33 are provided respectively at both ends of the terminal insertion hole 33 so that varnish in the terminal insertion hole 33 can easily move away without staying.

Figure 9:
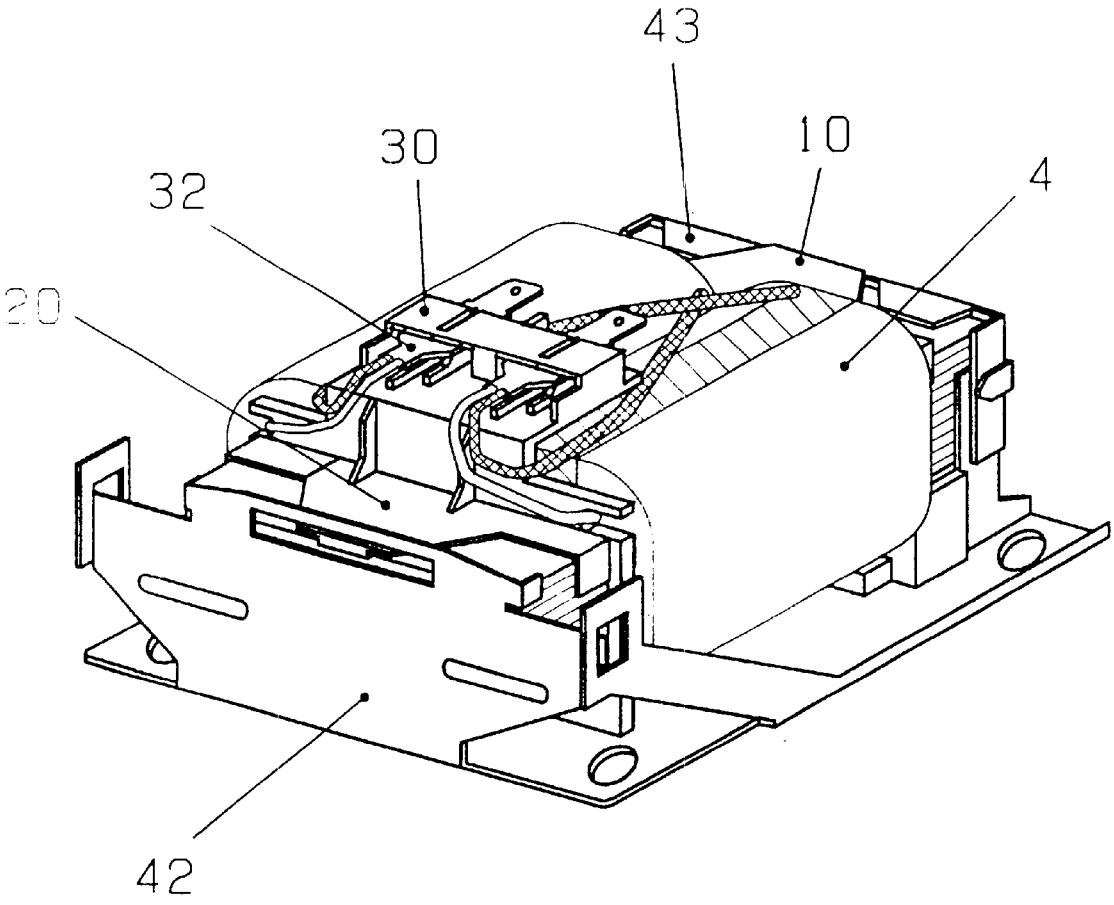
FIG. 9 is a perspective view showing how a reactor assembled is set in a metal frame.

FIG. 9 shows how the reactor, which is assembled with the two first cores 1, the two second cores 2 to be inserted into the two coils 4, the first spacer 10, and the second spacer 20 integrally molded with the terminal block 30, is set in the metal frame 42 and fixed by the side plate 43.

Figure 10:
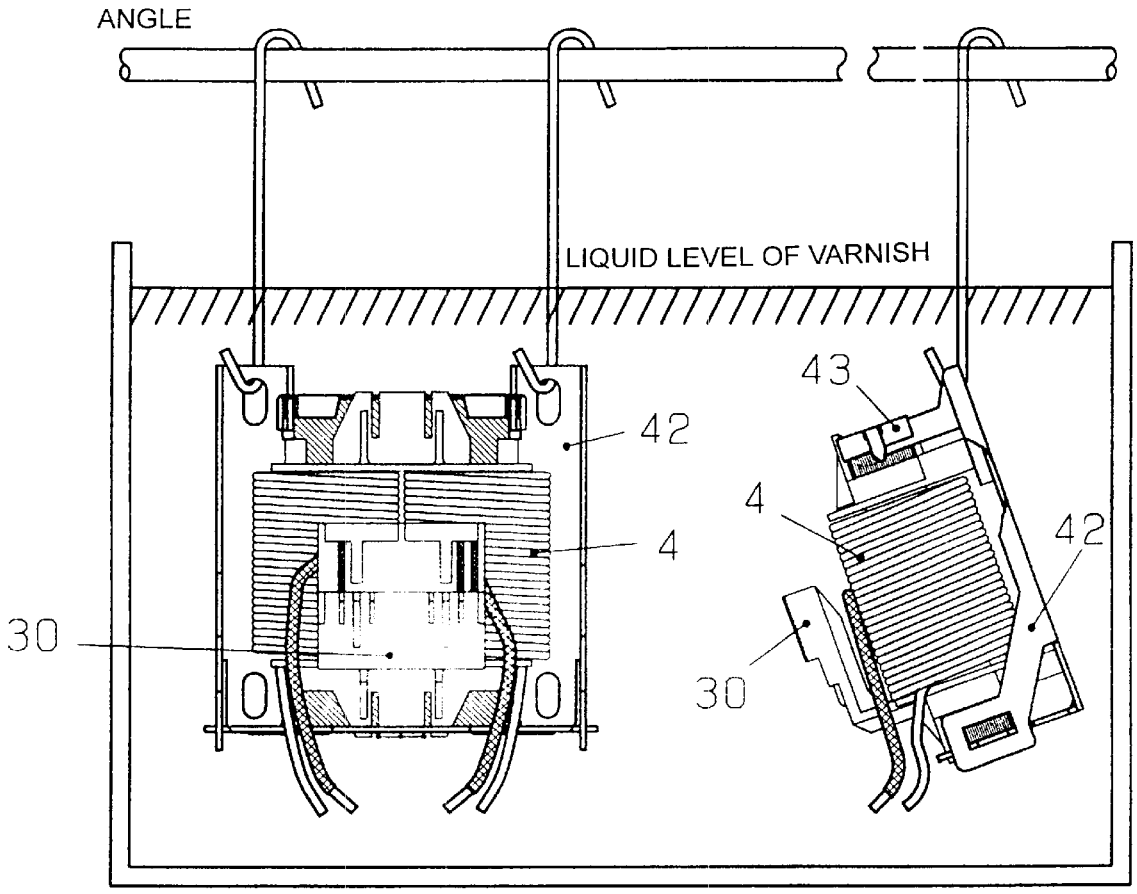
FIG. 10 is a schematic view showing how the reactor is impregnated with varnish.
Figure 11A:
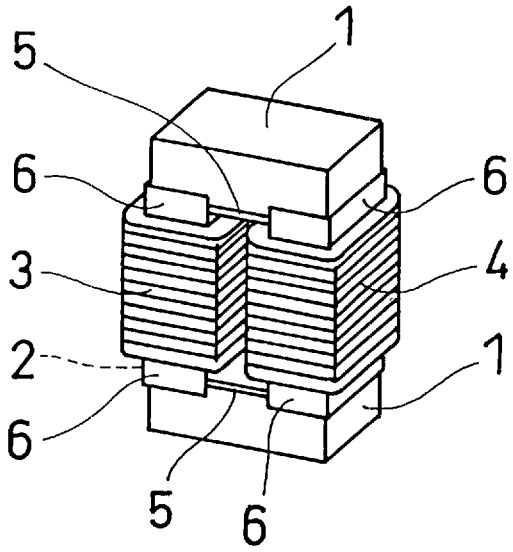
Fig. 11A Prior Art
FIG. 11A is a perspective view showing a conventional reactor.
Figure 11B:
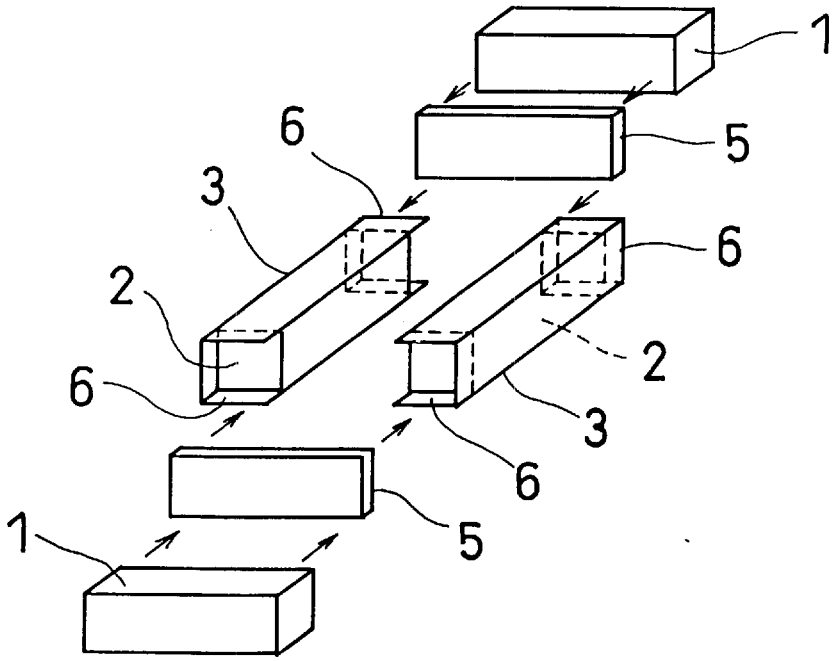
Fig. 11B Prior Art
FIG. 11B is an exploded perspective view showing a conventional reactor.

FIG. 10 shows how the reactor set in the metal frame is put in a varnish bath for impregnation. When a reactor together with a conventional terminal block is impregnated with varnish, varnish remains in a terminal insertion hole of the terminal block thereby hurting workability in inserting the terminal. Accordingly, a separate terminal block was attached to a reactor impregnated with varnish. In this invention, the grooves 302 having a width equivalent to the thickness of the terminal are provided along the terminal insertion hole 33, the partition 31 is provided halfway through the terminal insertion hole 33, and the apertures are provided around the terminal insertion hole 33 so as to communicate therewith so that varnish flows out when a reactor complete with a terminal block is impregnated with varnish as shown in FIG. 10.

The reactor according to the present invention has the following effects.

The reactor comprises the first and second cores and both of the cores are positioned and held by first and second spacers, then fixed, whereby coils, cores and metal fittings can be easily attached. Since one of the spacers is molded integrally with a terminal block and therefore a separate terminal block need not be made and attached, not only the number of parts but also the assembly time can be reduced, which can contribute to cost reduction. In addition, the spacers are reinforced by four protrusions for positioning two neighboring corners of the respective second cores and an elevated portion provided between the four protrusions and elevated in a direction perpendicular to the length of the first cores.

In the first spacer and the second spacer, the thickness at portions contacting the first core and the second core is made equal to a predetermined gap length between the first cores and the second cores, so the assembly time is reduced, which contributes to cost reduction, while giving little unevenness in quality.

The terminal block on the second spacer is provided with terminal insertion holes going therethrough in an insertion direction and with apertures being present at both sides of the respective terminal insertion holes and internally connecting with grooves and the terminal insertion hole, whereby varnish easily flows out instead of staying, which leads to improvement in workability.

In the first spacer and the second spacer, a gutter for receiving adhesive is provided at surfaces with which the first cores and the second cores come into contact, thereby preventing adhesive from failing to be applied. Accordingly, the strength of adhesion is improved with its unevenness reduced.

Since the elevated portions provided between the four protrusions on the respective inward side faces of the first spacer and the second spacer and elevated in the direction perpendicular to the length of the first cores are shaped so as to contact with two neighboring corners of the respective second cores, which do not contact with any of the four protrusions, the spacers are reinforced.

Since the elevated portion provided between the four protrusions on the respective inward side faces of the first spacer and the second spacer and elevated in the direction perpendicular to the length of the first core is shaped so as to contact with a longitudinal surface of the respective second cores, which do not contact with any of the four protrusions, the spacers are reinforced.

Since the four protrusions provided on the respective inward side faces of the first spacer and the second spacer and adapted to position the respective two second cores are configurated to hold the second cores at their inner surfaces and to engage with the inner peripheries of the coils provided on the second cores at their outer surfaces, the coils are in tight contact with the outer surfaces of the protrusions without a gap therebetween. Accordingly, the coils and the second cores are accurately positioned and the coils are stably held.

One of the protrusions provided on the respective outward side faces of the first spacer and the second spacer and fastening the longer sides of the respective first cores is sectioned by slits, and its middle section provided with elasticity and the tip end of the middle section together secure the first core, thereby prohibiting the core from coming off.

What is claimed is:

1. A reactor in which two first cores made of lamination and I-shaped and two second cores made of lamination and I-shaped are disposed such that the two first cores are parallel to each other, the two second cores are parallel to each other and that the two second cores having respective coils therearound are perpendicular to the two first cores, thereby forming a rectangular shape, characterized in that there are provided a first spacer and a second spacer integrated with a terminal block, which are molded of insulating resin, disposed parallel to each other with the two first cores set apart from each other so as to sandwich the two second cores, have on their respective outward side faces two protrusions for positioning each first core and two other protrusions for holding longer sides of each first core with one thereof having at its tip end an engaging mechanism to secure each first core, and which have on their respective inward side faces four protrusions for positioning two neighboring corners of the respective second cores and an elevated portion provided between the four protrusions and elevated in a direction perpendicular to the length of the first cores.

2. The reactor according to claim 1, wherein the first spacer and the second spacer are each formed such that a thickness at portions where the first spacer and the second spacer contact with the first cores and the second cores is equal to a predetermined gap length between the first cores and the second cores.

3. The reactor according to claim 1, wherein the terminal block integrally formed on the second spacer is provided with a plurality of terminal insertion holes going therethrough in an insertion direction, and the terminal insertion holes each have a plurality of apertures connecting therewith.

4. The reactor according to claim 1, wherein a gutter for adhesive to flow into is provided on the first spacer and the second spacer at areas with which the first cores and the second cores are in contact.

5. The reactor according to claim 1, wherein the elevated portion provided on the respective inward side faces of the first spacer and the second spacer is formed so as to contact with two other neighboring corners of the respective second cores, which are not in contact with any of the four protrusions.

6. The reactor according to claim 1, wherein the elevated portion provided on the respective inward side faces of the first spacer and the second spacer is formed so as to contact with one longitudinal surface of the respective second cores, which is not in contact with any of the four protrusions.

7. The reactor according to claim 1, wherein the four protrusions provided on the respective inward side faces of the first spacer and the second spacer are formed such that inner faces thereof hold the second cores and outer faces thereof engage with inner peripheries of the coils wound around the second cores.

8. The reactor according to claim 1, wherein one of the two other protrusions provided on the respective outward side faces of the first spacer and the second spacer has two slits thereby being split into three sections and a middle section of the three sections is provided with elesticity and has the engaging mechanism at its tip end.

* * * * *